US006354283B1

(12) United States Patent
Hawkins et al.

(10) Patent No.: US 6,354,283 B1
(45) Date of Patent: Mar. 12, 2002

(54) DIESEL ENGINE MODULAR CRANKCASE VENTILATION FILTER

(75) Inventors: Charles W. Hawkins, Sparta, TN (US); Christopher E. Holm, Madison, WI (US); Gregory W. Hoverson, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 39 days.

(21) Appl. No.: 09/649,857

(22) Filed: Aug. 29, 2000

(51) Int. Cl.[7] ..... F02B 25/06

(52) U.S. Cl. ..... 123/572

(58) Field of Search ..... 123/572, 573, 123/574, 41.86

(56) References Cited

U.S. PATENT DOCUMENTS

| | | | | | |
|---|---|---|---|---|---|
| 4,602,595 | A | * | 7/1986 | Aoki et al. | 123/41.86 |
| 4,607,604 | A | * | 8/1986 | Kanoh et al. | 123/572 |
| 5,024,203 | A | * | 6/1991 | Hill | 123/573 |
| 6,047,670 | A | * | 4/2000 | Stella et al. | 123/572 |
| 6,123,061 | A | * | 9/2000 | Baker et al. | 123/573 |

* cited by examiner

*Primary Examiner*—Marguerite McMahon
(74) *Attorney, Agent, or Firm*—Andrus, Sceales, Starke & Sawall, LLP

(57) ABSTRACT

A diesel engine crankcase ventilation filter has a flat low profile modular filter housing, preferably extending vertically and having a top opening closed by a modular filter element inserted downwardly thereinto and closing and completing the housing. The construction provides a closed crankcase ventilation, CCV, filter in mobile diesel engine applications of limited space.

24 Claims, 5 Drawing Sheets

26
122
136
140
104
144
142
210
212
190
4
90
64
192
72
76
194
176
184
186
30
180
168
188
150
170
108
110
172
60
196
34
36
84
94
88
116
202
206
106
208
200
68
112
58
214
198
114
204
86
80

FIG. 5
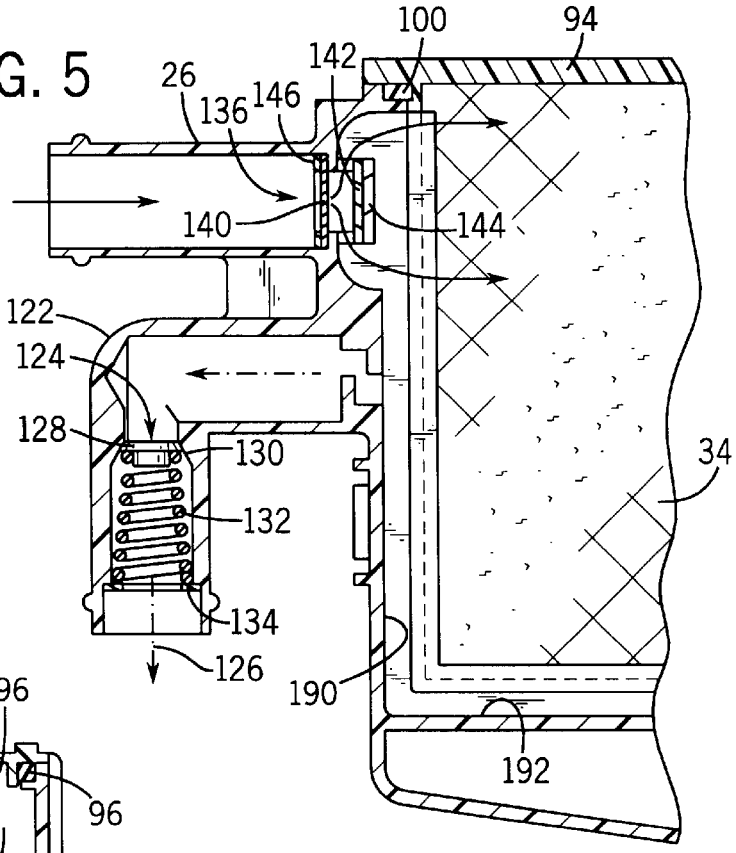
FIG. 7
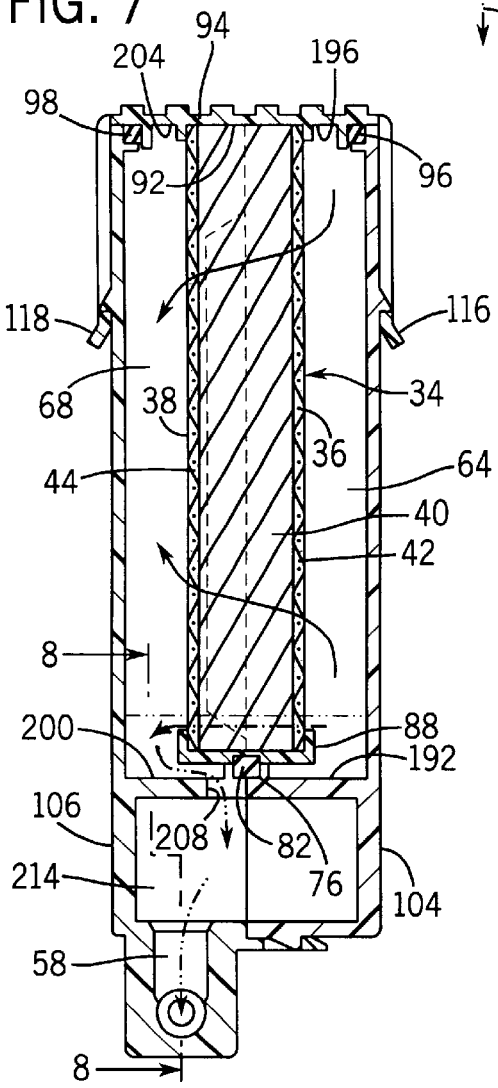
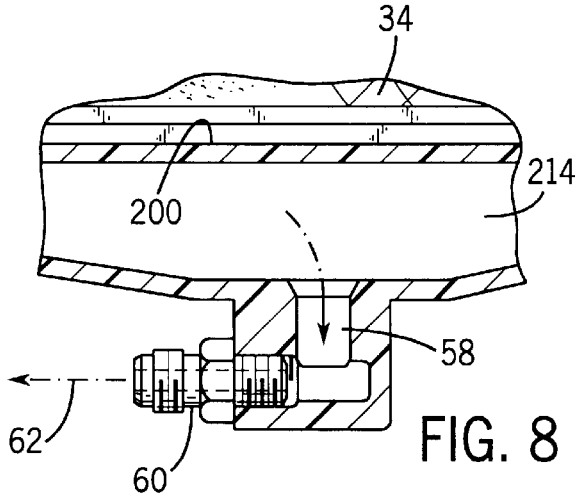
FIG. 8

DIESEL ENGINE MODULAR CRANKCASE VENTILATION FILTER

BACKGROUND AND SUMMARY

The invention relates to closed crankcase ventilation, CCV, filters for diesel engines.

Diesel engines have crankcase vents to relieve pressure buildup in the engine. A frequent cause of pressure buildup in the engine is from air leaking past the piston rings into the crankcase. The air that is vented out of the crankcase, also known as blow-by gas or crankcase gas, contains soot and oil mist particles. For many years, the blow-by gas along with the oil and soot was vented to atmosphere through a "road tube" to direct the flow to a desired area such as the ground, or away from specific engine parts. In recent years, metal mesh filters have been used to try and remove some of the larger oil droplets from the blow-by stream. These have had mixed results in the field. There have also been after-market products which remove oil mist and soot from engine blow-by gas. These products have been designed for industrial and stationary applications, and are usually too large and bulky for mobile applications.

Over the past few years, for appearance and environmental reasons, there has been motivation to eliminate the "road tube" type of design, and close the crankcase ventilation system. Closing the crankcase ventilation system means returning the blow-by gas back to the incoming combustion air stream to the engine, for example, at the air cleaner, turbocharger, intake manifold, or other engine intake. If a closed crankcase system is used, aerosol-sized droplets and soots, which for the most part are ignored in an open system, should be removed. This is desired in a closed system in order to avoid adverse effects on various engine components, especially the turbocharger and aftercooler. To do this, a degree of filtration beyond metal mesh is desired.

Packaging a closed crankcase ventilation system in a diesel engine compartment is a problem because of limited space. The closed crankcase ventilation, CCV, system requires routing hoses from the crankcase vent on the engine to the CCV housing, and from the CCV housing to either the dirty side of the air filter or to the turbo inlet of the diesel engine. Furthermore, a drain line needs to be run from the CCV housing back to the oil sump. A "stand alone" CCV system will have certain envelope requirements. For example, in a mid-range diesel engine, e.g. 150 to 300 horsepower, a projected envelope size would be a cylindrical housing of about four inches outer diameter and six to seven inches long plus room for connecting hoses, drain lines and valves. In mobile diesel engine applications, finding this amount of space in a convenient location is a problem.

The invention of commonly owned copending U.S. patent application Ser. No. 09/387,819, filed Sep. 1, 1999, provides a diesel engine crankcase ventilation filter addressing and solving the above-noted packaging and space problem, including the provision of a flat low profile crankcase ventilation filter, and enabling mounting of the flat low profile filter housing directly on the diesel engine valve cover in a horizontal orientation, with minimum space requirements and minimum plumbing requirements.

The present invention provides another solution to the noted packaging and space problem. The present invention provides a modular flat low profile crankcase ventilation filter and housing, and in preferred form enabling mounting in a vertical orientation. In a desirable aspect, the invention enables a modular housing construction provided by a pair of clamshell housing halves having a top opening closed by a modular filter element inserted downwardly thereinto and closing and completing the housing.

BRIEF DESCRIPTION OF THE DRAWINGS

FIG. 5 is a sectional view taken along line 5—5 of FIG. 6.

FIG. 7 is a sectional view taken along line 7—7 of FIG. 6.

FIG. 8 is a sectional view taken along line 8—8 of FIG. 7.

DETAILED DESCRIPTION OF THE INVENTION

Figure 1:
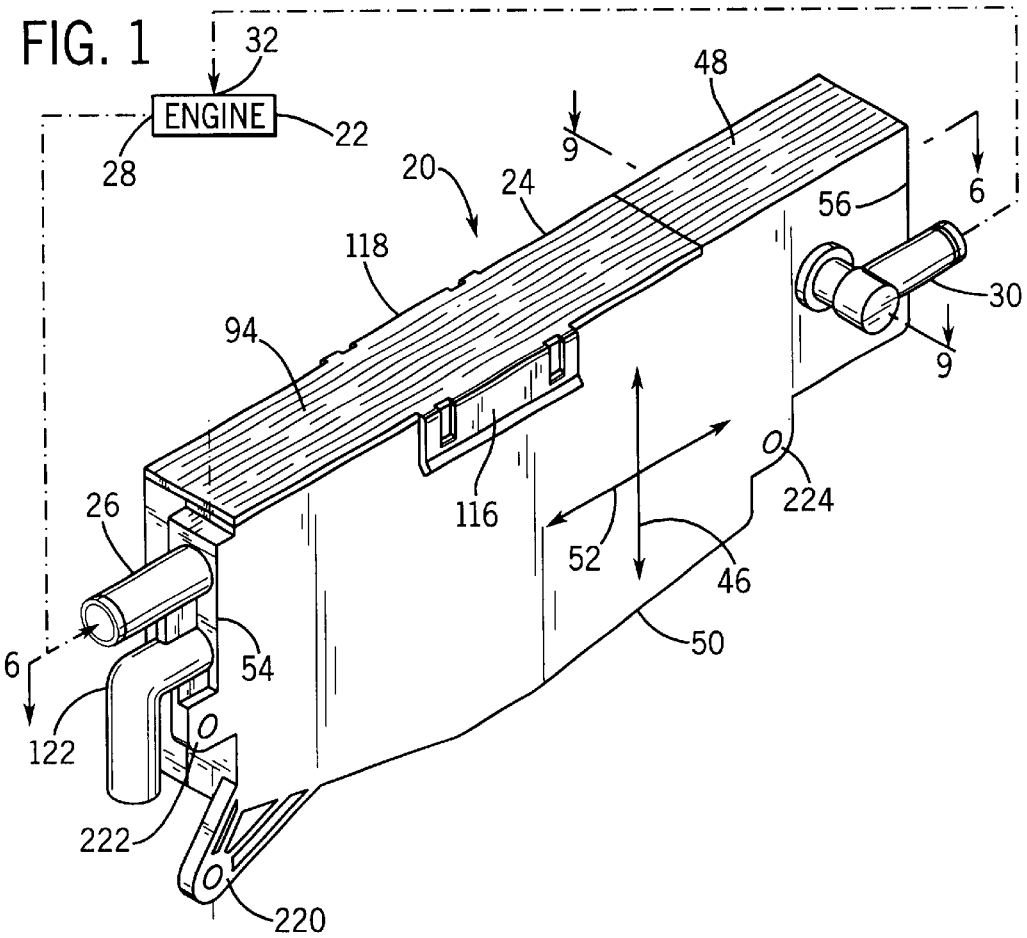
FIG. 1 is a perspective view of a diesel engine crankcase ventilation filter in accordance with the invention.

FIG. 1 shows a closed crankcase ventilation, CCV, filter 20 for a diesel engine 22. The filter has a flat low profile vertically extending modular filter housing 24 having an inlet 26 receiving oil and air from the crankcase 28 of the diesel engine, and having an outlet 30 returning air to the diesel engine at engine intake 32 such as the clean side or the dirty side of the air filter, the turbo charger inlet, the intake manifold, or other engine intake. A flat panel coalescing filter element 34, FIG. 2, extends vertically in the housing and has a first vertical side 36, FIGS. 2, 7, receiving the oil and air from inlet 26, FIG. 6, and separating the oil from the air, and having a second vertical side 38 passing air to outlet 30. In the orientation of FIG. 7, the oil and air flow from right to left through the filter element, with the oil mist, soot and particles coalescing in the filter. Flat panel filter element 34 is provided by coalescing filter media 40 sandwiched between outer wire mesh screens 42 and 44. Housing 24 extends vertically as shown at directional projection line 46, FIG. 1, between a top end 48 and a bottom end 50. The housing extends longitudinally as shown at directional projection line 52 between first and second distally opposite ends 54 and 56. Flat panel filter element 34 extends vertically and longitudinally in the housing. The oil falls by gravity and drips vertically along vertically extending flat panel filter element 34. The housing has a lower drain 58, FIGS. 2, 7, 8, discharging separated oil back to the engine oil sump through fitting 60 as shown at 62.

Figures 2, 4:
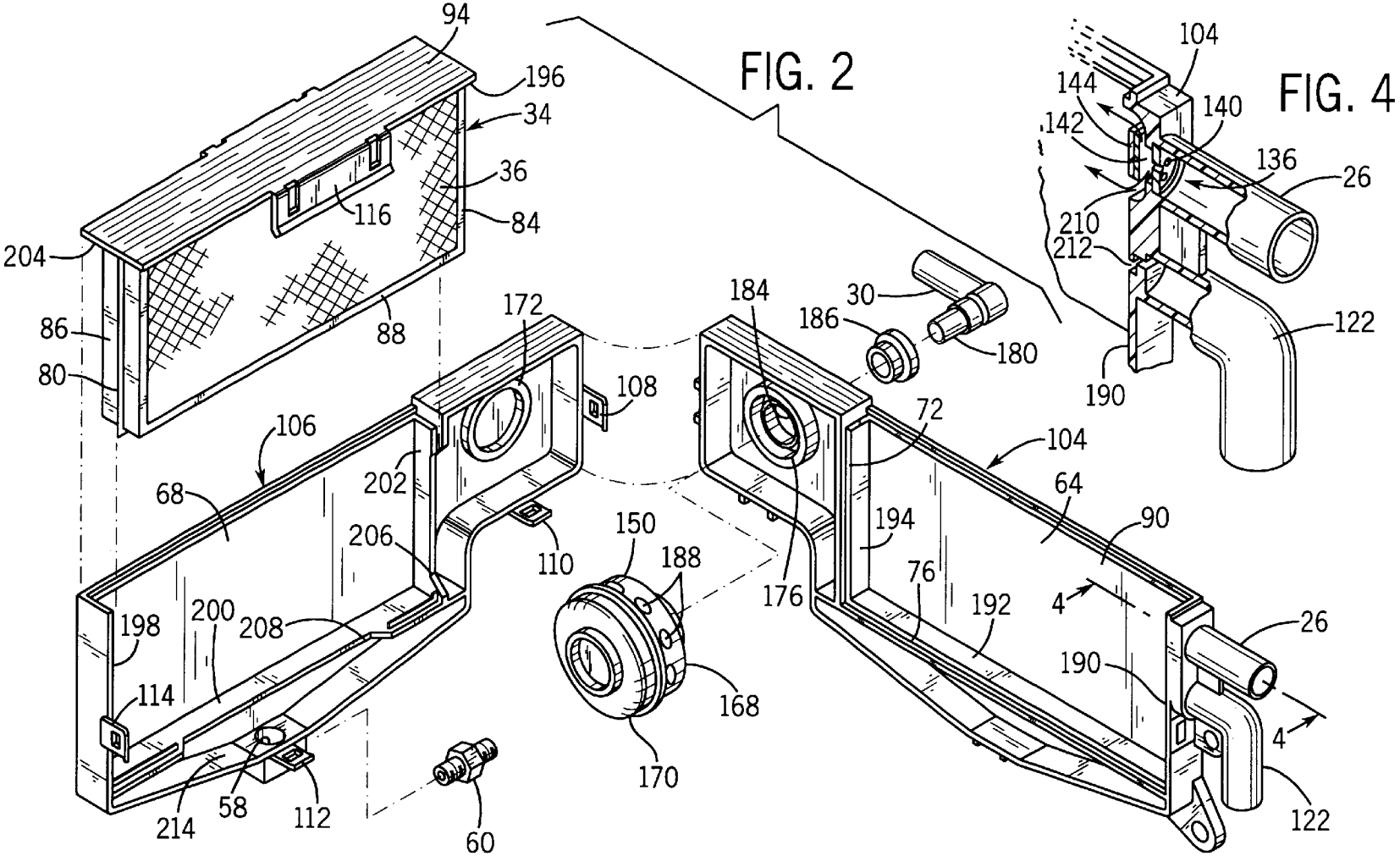
FIG. 2 is a disassembled exploded perspective view of the assembly of FIG. 1.
FIG. 4 is a partial sectional view taken along line 4—4 of FIG. 2.
Figure 6:
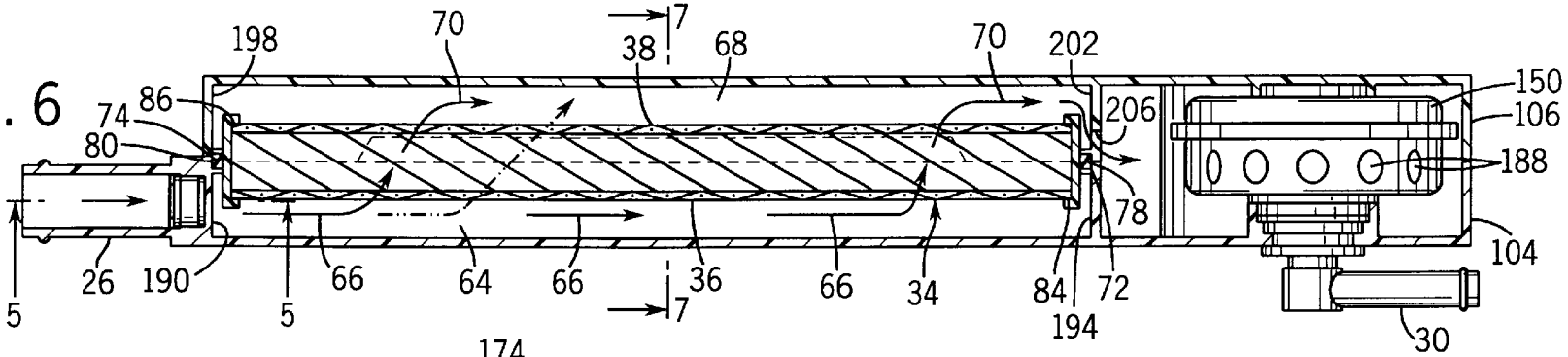
FIG. 6 is a sectional view taken along line 6—6 of FIG. 1.

Housing 24 has a first vertically and longitudinally extending flat plenum 64, FIGS. 2, 7, 6, facing first side 36 of filter element 34. Oil and air from inlet 26 flow through the first plenum as shown at arrows 66 in FIG. 6. The housing has a second vertically and longitudinally extending flat plenum 68, FIGS. 2, 7, 6, facing second side 38 of filter element 34. Air flows through second plenum 68, as shown at arrows 70 in FIG. 6, to outlet 30. The vertical and longitudinal extent of first plenum 64 is substantially the same as the vertical and longitudinal extent of first side 36 of filter element 34. The vertical and longitudinal extent of second plenum 68 is substantially the same as the vertical and longitudinal extent of second side 38 of the filter element. The vertical and longitudinal extent of plenums 64 and 68 are substantially the same.

Housing 24 has a vertically extending first filter mount guide channel 72, FIGS. 2, 6, and a vertically extending second filter mount guide channel 74. The guide channels engage and locate filter element 34 such that the filter element extends vertically in the housing and is located laterally between plenums 64 and 68. Housing 24 has a longitudinally extending lower filter mount guide channel 76, FIGS. 2, 7, engaging and locating filter element 34. Each of the guide channels 72, 74, 76 preferably engages a respective sealing gasket 78, 80, 82 on the filter element to seal plenum 64 from plenum 68. Sealing gaskets 78, 80, 82 are provided on respective end caps 84, 86, 88, FIG. 1, of the filter element.

Figure 11:
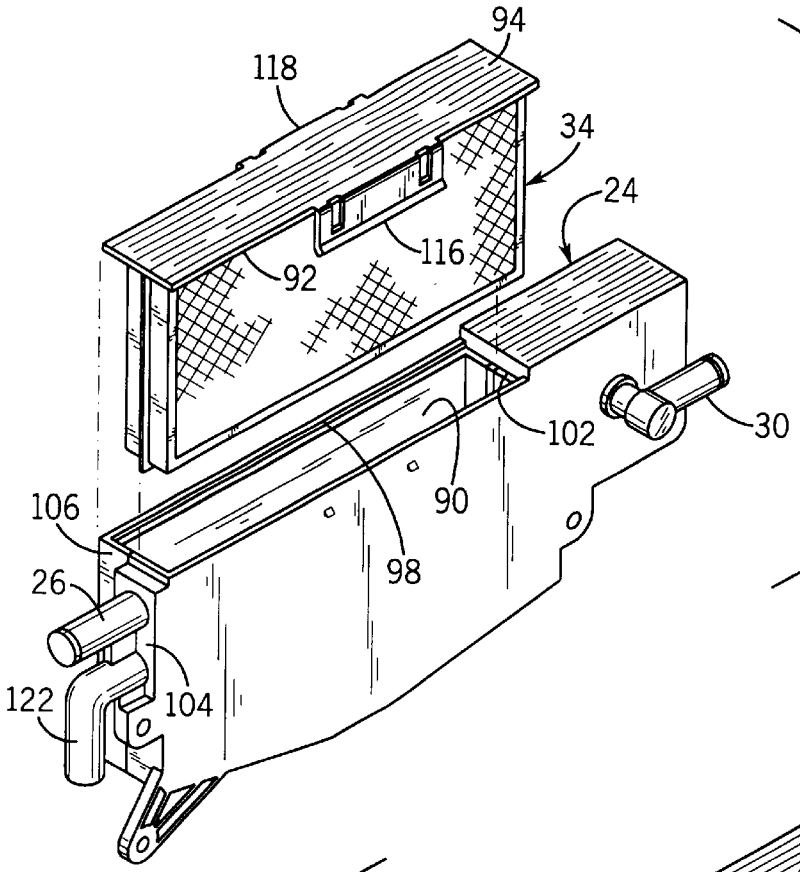
FIG. 11 is an exploded perspective view of the assembly of FIG. 1.

Housing 24 has a top opening 90, FIG. 11, receiving filter element 34 such that the filter element may be inserted downwardly into the housing. The filter element has a top end 92 with a top closure plate 94 sealingly attached thereto, by adhesive bonding, sonic welding, or other attachment. Filter element 34 and top closure plate 94 form an integral replaceable modular unit. As the filter element is inserted downwardly into housing 24 through open end 90, top closure plate 94 engages housing 24 and closes opening 90 and first and second plenums 64 and 68. Top closure plate 94 is sealed to the housing by a gasket around opening 94 including longitudinally extending gasket sections 96, 98, FIG. 7, and laterally extending gasket sections 100, FIG. 5, 102, FIG. 11. Filter element 34 is sealed at vertical end 84 by gasket 78 in guide channel 72. Filter element 34 is sealed at its lower horizontal longitudinal end 88 by gasket 82 in lower guide channel 76. Filter element 34 is sealed at its vertical end 86 by gasket 80 in guide channel 74. Filter element 34 is sealed at its top end 92 by closure plate 94 which in turn is sealed by the noted gaskets 96, 98, 100, 102 in housing opening 90.

Figure 10:
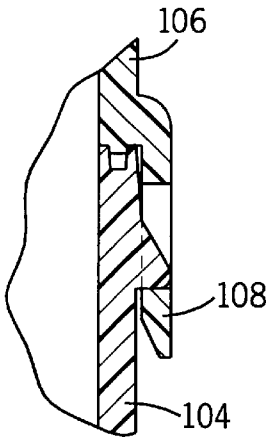
FIG. 10 is an enlarged view of a portion of FIG. 9.
Figure 12:
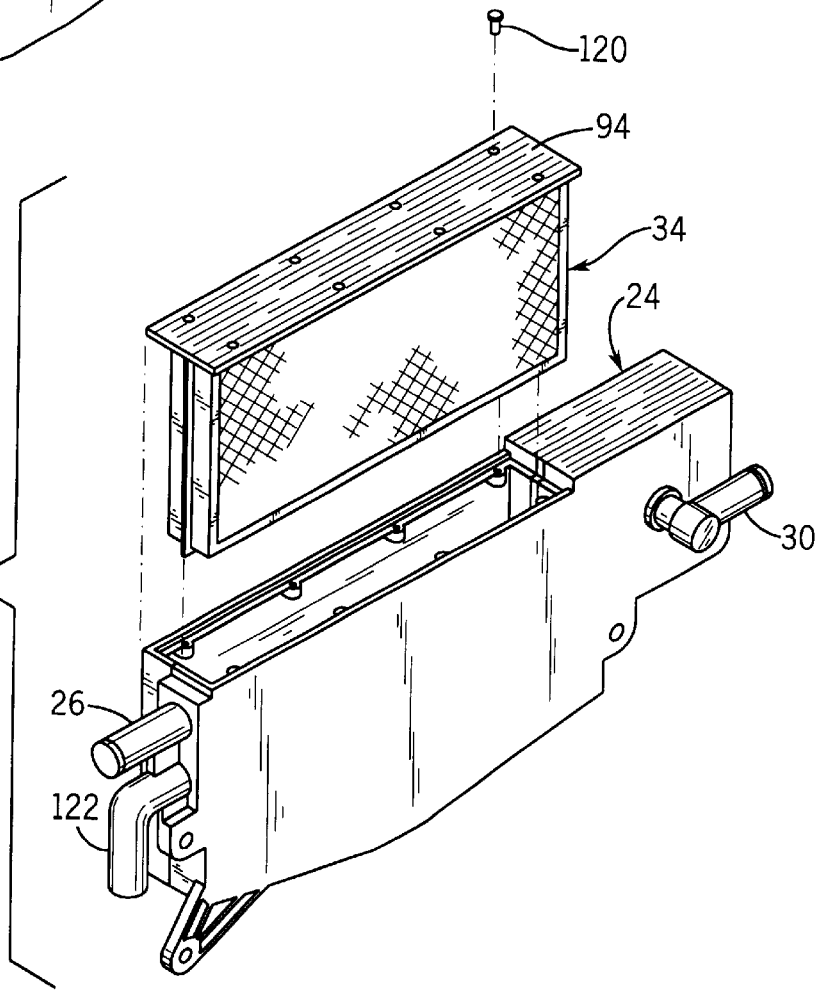
FIG. 12 is like FIG. 11 and shows another embodiment.

Housing 24 is provided by a pair of clamshell halves 104, 106, FIG. 2, having the noted top opening 90 in assembled condition, FIG. 11. Alternatively, housing 24 is a single unitary member. Top closure plate 94 of the filter element mates with the clamshell halves, or a single unitary housing, and closes top opening 90 such that top closure plate 94 of filter element 34 completes the housing, including if the housing is formed by the clamshell halves. The clamshell halves are plastic members and are held together by flexible snap fit tabs 108, 110, 112, 114, FIGS. 2, 9, 10. Top closure plate 94 is a plastic member and has a pair of flexible downwardly extending side tabs 116, 118 engaging respective clamshell halves 104, 106 in snap fit relation. Other attachment mechanisms may be used for the clamshell halves and/or the top closure plate, for example, screws such as 120, FIG. 12.

Housing 24 has a bypass port 122, FIGS. 2, 4, communicating with inlet 26. A bypass valve 124, FIG. 5, in the bypass port has a normally closed position, which is the position illustrated in FIG. 5, such that air and oil from inlet 26 flow to filter element 34. Bypass valve 124 has a pressure actuated open position passing the air and oil therethrough as an alternate path as shown at 126, preferably back to atmosphere or to the engine intake. Bypass valve 124 is actuated to the open position in response to an overpressure condition in plenum 64 corresponding to a predetermined pressure drop across filter element 34, to ensure venting of the engine crankcase even if filter element 34 becomes plugged. Bypass valve 124 is provided by frusto-conical plunger 128 biased upwardly against mating valve seat 130 by compression spring 132 bearing at its lower end against stationary snap ring 134. When the pressure in plenum 64 increases sufficiently to overcome the bias of spring 132, plunger 128 moves downwardly away from valve seat 130 to permit flow therepast.

Figure 3:
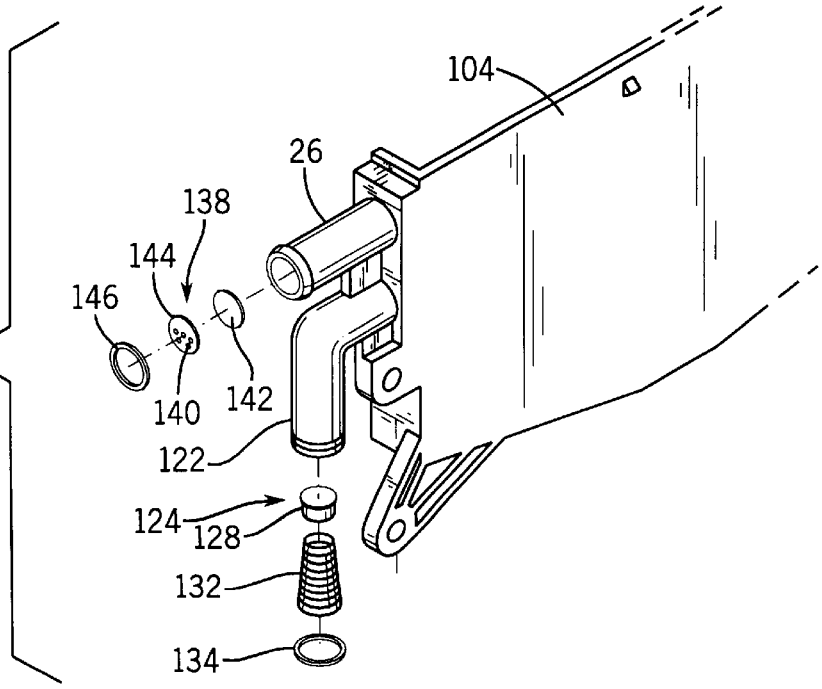
FIG. 3 is a disassembled exploded perspective view of a portion of FIG. 1.

A precleaner 136, FIGS. 4, 5, at input 26 is provided by an inertial air-oil separator 138, FIG. 3, having a plurality of nozzles 140 accelerating the air-oil stream, and an inertial collector 142 in the path of such stream and causing a sharp directional change thereof. Nozzles 140 are provided by a plurality of apertures in a disc 144 held in input 26 by stationary snap ring 146, FIG. 5. Collector 142 is provided by a rough, porous collection surface as in commonly owned copending U.S. application Ser. No. 09/356,072, filed Jul. 16, 1999. The collection surface is provided on an inner recessed surface 144 of the housing. The rough porous collection surface causes oil particle separation from the air-oil stream of smaller size oil particles than a smooth, non-porous impactor impingement surface and without size cut-off of the latter, to improve overall efficiency including for particles smaller than the cut-off size for a smooth, non-porous impactor impingement surface. Precleaner 136 is upstream of filter element 34 and provides extended life of filter element 34. Bypass valve 124 communicates with plenum 64 downstream of precleaner 136.

Figure 9:
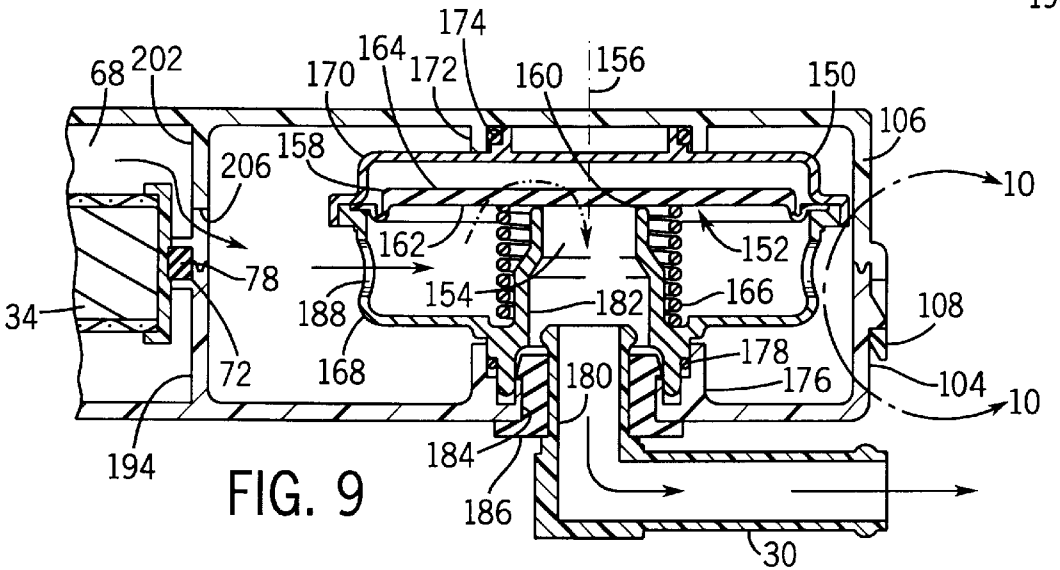
FIG. 9 is a sectional view taken along line 9—9 of FIG. 1.

A vacuum control module 150, FIG. 2, is provided in housing 24 between plenum 68 and outlet 30, FIGS. 6, 9. The module has a valve 152, FIG. 9, having a normally open position such that intake manifold vacuum and/or turbo charger inlet vacuum is communicated back through outlet 30, housing 24, and inlet 26 to engine crankcase 28, such that air and oil flow from crankcase 28 to housing inlet 26 into plenum 64 then through filter element 34, and then air flows through second plenum 68 then through valve 152 as shown at arrow 154, FIG. 9, then through housing outlet 30 to intake 32 of the engine. Valve 152 has a vacuum actuated closed position, which is the position illustrated in FIG. 9, blocking air flow therethrough. Valve 152 is actuated to the closed position in response to a predetermined vacuum in engine intake 32, to prevent communication of excessive vacuum to crankcase 28 through housing 24. Valve 152 is reciprocal between its open and closed positions along a lateral axis of movement 156 perpendicular to vertical extension 46 of housing 24 and perpendicular to longitudinal extension 52 of housing 24. Valve 152 is provided by a flat disc diaphragm 158 extending vertically and longitudinally in the housing and moveable laterally along axis 156 against a valve seat 160 to the closed position. Diaphragm 158 has a first side 162 facing laterally toward and engageable with valve seat 160, and has a second side 164 facing laterally oppositely from first side 162. Second plenum 68 communicates with first side 162. A compression spring 166 biases diaphragm 158 away from valve seat 160 such that air from plenum 68 flows past valve seat 160 to outlet 30. The noted predetermined vacuum from engine intake 32 overcomes the bias of spring 166 to pull diaphragm 158 laterally along axis 156 against valve seat 160 to the closed position.

Module 150, FIGS. 2, 9, is provided by a pair of cup-like housing sections 168,170 pinching and sealing the outer periphery of diaphragm 158 therebetween. Housing section 170 is nested in raised annular shoulder 172 of clamshell half 106 and held securely therein in friction fit relation by O-ring 174. Housing section 168 is nested in raised annular shoulder 176 of clamshell half 104 and held therein in friction fit and sealing relation by O-ring 178. Outlet 130 includes an inner leg 180 extending into opening 182 of housing section 168 and through opening 184 of clamshell half 104 and sealed thereto by grommet 186. Housing section 168 has a plurality of apertures 188 providing communication therethrough between plenum 68 and valve 152.

As noted above, upper border end 92 of filter element 34 has closure plate 94 attached thereto. The closure plate mates with clamshell halves 104 and 106 and closes opening 90, such that filter element 34 and closure plate 94 form a module which completes housing 24 formed by clamshell halves 104 and 106. Filter element 34 is a flat low profile element. Housing 24 has the noted first flat low profile plenum 64 facing first side 36 of the filter element, and a second flat low profile plenum 68 facing the second side 38 of the filter element. Clamshell half 104 has first, second and third border fences 190, 192 and 194, respectively, FIG. 2, mating with filter element 34 and having inner edges forming the noted filter mount guide channels 74, 76 and 72, respectively. Closure plate 94 has a first section 196 adjacent first side 36 of filter element 34 and providing a fourth border fence. The first, second, third and fourth border fences 190, 192, 194 and 196 define a perimeter which in turn defines and extends around first plenum 64. Second clamshell half 106 has fifth, sixth and seventh border fences 198, 200 and 202, respectively, mating with filter element 34 and forming at their inner edges the noted filter mount guide channels 74, 76 and 72, respectively. Top closure plate 94 has a second section 204 adjacent second side 38 of filter element 34 and providing an eighth border fence. The fifth, sixth, seventh and eighth border fences 198, 200, 202 and 204, respectively, define a perimeter which in turn defines and extends around second plenum 68. Border fence 202 has a cut-out 206 therein, FIGS. 2, 9, permitting passage of air from second plenum 68 to valve 152 and outlet 30. Border fence 200 has a cut-out 208, FIGS. 2, 7, permitting passage of oil from second plenum 68 to drain 58. Housing 24 extends vertically from the noted fourth and eighth border fences 196 and 204 downwardly to the noted second and sixth border fences 192 and 200. The housing extends longitudinally from the noted first and fifth border fences 190 and 198 to the noted third and seventh border fences 194 and 202. First border fence 190, FIG. 4, has a first opening 210 therein at inlet 26, and a second opening 212 therein providing bypass port 122. Housing 124 has a lower chamber 214, FIGS. 2, 7, 8, below the noted second and sixth border fences 192 and 200 and communicating with second plenum 68 through cut-out 208 in sixth border fence 200. Lower chamber 214 provides a collection chamber for separated oil, and has the noted drain port 58 therefrom.

The noted combination of valves 124 and 152 maintains engine crankcase pressure within a desired range. Valve 124 prevents excessive positive pressure in the crankcase otherwise caused by plugging of filter element 34. Valve 152 prevents excessive negative pressure in the crankcase otherwise caused by a high vacuum condition of the engine intake communicated back through housing 24. The noted valving is provided in a compact low profile flat modular filter housing. Flat disc diaphragm 158 extends vertically and longitudinally in the housing, i.e. along the plane of the housing, and its opening and closing movement is along lateral axis 156 perpendicular to such vertical and longitudinal plane of the housing. This facilitates flat low profile construction. Axis 156 is parallel to the direction of flow through filter element 34 from first side 36 to second side 38. The direction of oil and air flow from inlet 26 to first side 36 of the filter element is along the plane of the housing, and the direction of air flow from second side 38 of the filter element to valve 152 is also along the plane of the housing. Valve 124 is reciprocal between its open and closed positions along an axis of movement along the plane of the housing. First and second valves 124 and 152 are at distally opposite ends of the housing and separated by filter element 34 therebetween. The housing is mounted in the engine compartment in the preferred vertical orientation by mounting tabs 220, 222, 224.

It is recognized that various equivalents, alternatives and modifications are possible within the scope of the appended claims.

What is claimed is:

1. A diesel engine crankcase ventilation filter comprising a flat low profile vertically extending filter housing having an inlet receiving oil and air from said diesel engine, and an outlet returning air to said diesel engine, a flat filter element extending vertically in said housing and having a first vertical side receiving said oil and air from said inlet, and separating said oil from said air, and having a second vertical side passing air to said outlet, wherein said housing extends vertically from a top end to a bottom end, and extends longitudinally from a first end to a second end, and wherein said flat panel filter element extends vertically and longitudinally in said housing, said housing has a lower drain discharging separated oil, and wherein said oil falls by gravity and drips vertically along said vertically extending flat panel filter element, said housing has a first vertically and longitudinally extending flat plenum facing first side of said filter element, wherein said oil and air from said inlet flow through said first plenum, said housing has a second vertically and longitudinally extending flat plenum facing said second side of said filter element, wherein said air flows through second plenum to said outlet, said housing has a vertically extending first filter mount guide channel, and a vertically extending second filter mount guide channel, said guide channels engaging and locating said filter element such that said filter element extends vertically in said housing and is located laterally between said first and second plenums, said housing has a longitudinally extending lower filter mount guide channel engaging and locating said filter element, and wherein each of said first, second and lower guide channels includes a scaling gasket sealing said first plenum from said second plenum, said housing has a top opening receiving said filter element such that said filter element may be inserted downwardly into said housing, and wherein said filter element has a top end with a top closure plate sealingly attached thereto, such that as said filter element is inserted into said housing, said top closure plate engages said housing and closes said first and second plenums, and wherein said filter element has a first vertically extending end sealed by said sealing gasket of said first guide channel, a second vertically extending end sealed by said scaling gasket of said second guide channel, and a lower end sealed by said sealing gasket of said lower guide channel, and wherein filter element has a top end sealed by its attachment to said top closure plate.

2. The invention according to claim 1 wherein said housing comprises a pair of clamshell halves having a top opening in an assembled condition, and wherein said top closure plate of said filter element mates with said clamshell halves and closes top opening, such that said top closure plate of said filter element completes said housing formed by said clamshell halves.

3. The invention according to claim 1 wherein said housing comprises a single unitary member having a top opening, and wherein said top closure plate of said filter element mates with said housing and closes said top opening, such that said top closure plate of said filter element completes said housing.

4. A diesel engine crankcase ventilation filter comprising a flat low profile vertically extending filter housing having an inlet receiving oil and air from said diesel engine, and an outlet returning air to said diesel engine, a flat filter element extending vertically in said housing and having a first vertical side receiving said oil and air from said inlet, and separating said oil from said air, and having a second vertical side passing air to said outlet, wherein said housing extends vertically from a top end to a bottom end, and extends longitudinally from a first end to a second end, and wherein said flat panel filter element extends vertically and longitudinally in said housing, said housing has a lower drain discharging separated oil, and wherein said oil falls by gravity and drips vertically along said vertically extending flat panel filter element, said housing has a first vertically and longitudinally extending flat plenum facing first side of said filter element, wherein said oil and air from said inlet flow through said first plenum, said housing has a second vertically and longitudinally extending flat plenum facing said second side of said filter element, wherein said air flows through second plenum to said outlet, and comprising a precleaner at said input comprising an inertial air-oil separator having a plurality of nozzles accelerating the air-oil stream, and an inertial collector in the path of said stream and causing a sharp directional change thereof and having a rough porous collection surface causing oil particle separation from said air-oil stream of smaller size oil size particles than a smooth non-porous impactor impingement surface and without the sharp cut-off size of the latter, to improve overall efficiency including for particles smaller than the cut-off size for a smooth non-porous impactor impingement surface, said precleaner being upstream of said filter element and providing extended life of said filter element.

5. The invention according to claim 4 comprising a valve communicating with said first plenum downstream of said precleaner, said valve having a normally closed position such that air and oil from said inlet flow to said filter element, said valve having a pressure actuated open position passing said air and oil therethrough as an alternate path, said valve being actuated to said open position in response to a predetermined pressure drop across said filter element.

6. A diesel engine crankcase ventilation filter comprising a flat low profile vertically extending filter housing having an inlet receiving oil and air from said diesel engine, and an outlet returning air to said diesel engine, a flat filter element extending vertically in said housing and having a first vertical side receiving said oil and air from said inlet, and separating said oil from said air, and having a second vertical side passing air to said outlet, wherein said housing extends vertically from a top end to a bottom end, and extends longitudinally from a first end to a second end, and wherein said flat panel filter element extends vertically and longitudinally in said housing, said housing has a lower drain discharging separated oil, and wherein said oil falls by gravity and drips vertically along said vertically extending flat panel filter element, said housing has a first vertically and longitudinally extending flat plenum facing first side of said filter element, wherein said oil and air from said inlet flow through said first plenum, said housing has a second vertically and longitudinally extending flat plenum facing said second side of said filter element, wherein said air flows through second plenum to said outlet, said diesel engine has an engine intake, and has a crankcase, and wherein said inlet of said housing receives air and oil from said crankcase, and said outlet of said housing supplies air to said engine intake, and comprising a vacuum control module in said housing between said second plenum and said outlet, said module comprising a valve having a normally open position, such that air and oil flows from said crankcase to said housing inlet into said first plenum then through said filter element, and then air flows through said second plenum then through said valve then through said housing outlet to said engine intake, said valve having a vacuum actuated closed position blocking air flow therethrough, said valve being actuated to said closed position in response to a predetermined vacuum in said engine intake, to prevent communication of excessive vacuum to said crankcase through said housing.

7. The invention according to claim 6 wherein said valve is reciprocal between said open and closed positions along a lateral axis of movement perpendicular to said vertical extension of said housing and perpendicular to said longitudinal extension of said housing.

8. The invention according to claim 7 wherein said valve comprises a flat disc diaphragm extending vertically and longitudinally and movable laterally against a valve seat to said closed position.

9. The invention according to claim 8 wherein said diaphragm has a first side facing laterally toward and engageable with said valve seat, and a second side facing laterally oppositely from said first side, and wherein said second plenum communicates with said first side of said diaphragm, and comprising a spring biasing said diaphragm away from said valve seat such that air from said second plenum flows past said valve seat to said outlet, and such that said predetermined vacuum overcomes the bias of said spring to pull said diaphragm laterally against said valve seat to said closed position.

10. A diesel engine crankcase ventilation filter comprising a filter housing having an inlet receiving oil and air from said diesel engine, and an outlet returning air to said diesel engine, said housing comprising first and second sections having an opening therebetween, a filter element having a first side receiving said oil and air from said inlet, and a second side passing air to said outlet, said filter element having a border end with a closure plate attached thereto, said closure plate mating with said first and second sections and closing said opening, such that said filter element and closure plate form a module which completes said housing formed by said first and second sections.

11. The invention according to claim 10 wherein said filter element is a flat low profile element, said housing has a first flat low profile plenum facing said first side of said filter element, and a second flat low profile plenum facing said second side of said filter element, said first section of said housing has first, second and third border fences mating with said filter element, said closure plate has a first section adjacent said first side of said filter element and providing a fourth border fence, said first, second, third and fourth border fences define a perimeter which in turn defines and extends around said first plenum, said second section of said housing has fifth, sixth and seventh border fences mating with said filter element, said closure plate has a second section adjacent said second side of said filter element and providing an eighth border fence, said fifth, sixth, seventh and eighth border fences define a perimeter which in turn defines and extends around said second plenum, and wherein one of said fifth, sixth and seventh border fences has a cut-out therein permitting passage of air from said second plenum to said outlet.

12. The invention according to claim 11 wherein said housing has a drain discharging separated oil, and wherein another of said fifth, sixth and seventh border fences has a cut-out therein permitting passage of oil from said second plenum to said drain, said one of said fifth, sixth and seventh border fences being different than said other of said fifth, sixth and seventh border fences.

13. The invention according to claim 12 wherein said housing extends vertically from said fourth and eighth border fences downwardly to said second and sixth border fences, and wherein said housing extends longitudinally from said first and fifth border fences to said third and seventh border fences, and wherein said seventh border fence has said one cut-out permitting passage of air from said second plenum to said outlet, and wherein said sixth border fence has said other cut-out permitting passage of oil from said second plenum to said drain.

14. The invention according to claim 13 wherein said first border fence has an opening therein at said inlet.

15. The invention according to claim 14 wherein said first border fence has a second opening therein providing a bypass port, and comprising a valve in said bypass port and having a normally closed position such that air and oil from said inlet flow to said filter element, said valve having a pressure actuated open position passing said air and oil therethrough as an alternate path, said valve being actuated to said open position in response to a predetermined pressure drop across said filter element.

16. The invention according to claim 13 wherein said housing has a lower chamber below said second and sixth border fences and communicating with said second plenum through said other cut-out in said sixth border fence, said lower chamber providing a collection chamber for separated oil and having a drain port therefrom.

17. The invention according to claim 10 wherein said first and second sections of said housing are provided by a pair of clamshell halves having said opening in assembled condition, said closure plate mating with said clamshell halves and closing said opening, such that said filter element and closure plate from said module which completes said housing formed by said clamshell halves.

18. The invention according to claim 17 wherein a first of said clamshell halves has said first, second and third border fences, and the second of said clamshell halves has said fifth, sixth and seventh border fences.

19. The invention according to claim 10 wherein said first and second sections of said housing are integral with each other such that said housing is a single unitary member.

20. A crankcase ventilation filter for a diesel engine having an engine intake, and a crankcase, said filter comprising a housing having an inlet receiving oil and air from said crankcase, and an outlet returning air to said engine intake, a filter element in said housing and having a first side receiving said oil and air from said inlet, and separating said oil from said air, and having a second side passing air to said outlet, a bypass port communicating with said inlet, a first valve in said bypass port, said first valve having a normally closed position such that oil and air from said inlet flow to said filter element, said first valve having a pressure actuated open position passing said oil and air therethrough as an alternate path, said first valve being actuated to said open position in response to a predetermined pressure drop across said filter element, a vacuum control module in said housing between said second side of said filter element and said outlet, said module comprising a second valve having a normally open position such that oil and air flow from said crankcase through said inlet to said first side of said filter element then through said filter element and then air flows from said second side of said filter element through said second valve then through said housing outlet to said engine intake, said second valve having a vacuum actuated closed position blocking air flow therethrough, said second valve being actuated to said closed position in response to a predetermined vacuum in said engine intake, to prevent communication of excessive vacuum to said crankcase through said housing.

21. The invention according to claim 20 wherein said second valve is reciprocal between said open and closed positions along a given axis of movement substantially parallel to the direction of flow through said filter element from said first side to said second side.

22. The invention according to claim 21 wherein said housing is a flat low profile member extending along a given plane, said filter element is a flat low profile member extending along said plane within said housing, and wherein said axis of movement of said second valve is perpendicular to said plane.

23. The invention according to claim 22 wherein the direction of oil and air flow from said inlet to said first side of said filter element is along said plane, the direction of air flow from said second side of said filter element to said second valve is along said plane, and wherein said first valve is reciprocal between said open and closed positions along an axis of movement along said plane.

24. The invention according to claim 20 wherein said first and second valves are at distally opposite ends of said housing and separated by said filter element therebetween.

* * * * *